US009190711B2

(12) United States Patent
Yamaguchi et al.

(10) Patent No.: US 9,190,711 B2
(45) Date of Patent: Nov. 17, 2015

(54) ANTENNA DEVICE AND COMMUNICATION APPARATUS INCLUDING THE SAME

(75) Inventors: Shuichiro Yamaguchi, Miyazaki (JP); Kouichi Nakamura, Miyazaki (JP); Yasutaka Hieda, Miyazaki (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 732 days.

(21) Appl. No.: 13/191,156

(22) Filed: Jul. 26, 2011

(65) Prior Publication Data

US 2012/0025939 A1 Feb. 2, 2012

(30) Foreign Application Priority Data

Jul. 28, 2010 (JP) ..... 2010-168893
Dec. 20, 2010 (JP) ..... 2010-282784

(51) Int. Cl.
*H01Q 1/24* (2006.01)
*H01Q 7/06* (2006.01)
*H01Q 1/22* (2006.01)

(52) U.S. Cl.
CPC ..... *H01Q 1/243* (2013.01); *H01Q 1/2216* (2013.01); *H01Q 7/06* (2013.01)

(58) Field of Classification Search
CPC ..... H01Q 1/22; H01Q 1/2208; H01Q 1/2216; H01Q 1/2225; H01Q 1/24; H01Q 1/241; H01Q 1/242; H01Q 1/243; H01Q 1/245; H01Q 1/36; H01Q 1/362; H01Q 11/08; H01Q 11/083; H01Q 3/44; H01Q 7/06; G06K 7/00–7/1495; G06K 19/00–19/18
See application file for complete search history.

(56) References Cited

U.S. PATENT DOCUMENTS

| | | | | |
|---|---|---|---|---|
| 6,930,646 | B2 * | 8/2005 | Yahata et al. | 343/718 |
| 7,280,076 | B2 * | 10/2007 | Ninomiya et al. | 343/702 |
| 7,495,625 | B2 * | 2/2009 | Endo et al. | 343/788 |
| 7,699,231 | B2 | 4/2010 | Yamaguchi | |
| 8,125,401 | B2 * | 2/2012 | Ito et al. | 343/788 |
| 8,294,629 | B2 * | 10/2012 | Yosui et al. | 343/788 |
| 2005/0162331 | A1 | 7/2005 | Endo | |
| 2008/0007473 | A1 * | 1/2008 | Yosui et al. | 343/788 |
| 2008/0238799 | A1 * | 10/2008 | Tsushima | 343/788 |
| 2009/0066466 | A1 * | 3/2009 | Arimura | 336/221 |
| 2009/0096694 | A1 | 4/2009 | Ito | |
| 2009/0315792 | A1 | 12/2009 | Miyashita | |
| 2011/0050535 | A1 | 3/2011 | Yamaguchi | |
| 2011/0156978 | A1 | 6/2011 | Ito | |
| 2011/0195661 | A1 | 8/2011 | Miyashita | |
| 2012/0081257 | A1 * | 4/2012 | Yosui et al. | 343/788 |

(Continued)

FOREIGN PATENT DOCUMENTS

| | | |
|---|---|---|
| EP | 1 484 816 | 12/2004 |
| EP | 2 040 334 | 3/2009 |

(Continued)

OTHER PUBLICATIONS

Extended European Search Report dated Nov. 16, 2011.

*Primary Examiner* — Robert Karacsony
*Assistant Examiner* — Patrick Holecek
(74) *Attorney, Agent, or Firm* — Seed IP Law Group PLLC

(57) ABSTRACT

There is disclosed an antenna device including: a metal portion which has a surface; and a coil section which is provided above the surface of the metal portion and has an opening portion. Here, a surface of the coil section in which the opening portion is formed is approximately perpendicular to the surface of the metal portion, and the coil section is disposed in the vicinity of an edge of the metal portion.

19 Claims, 11 Drawing Sheets

(56) References Cited

U.S. PATENT DOCUMENTS

| | | | |
|---|---|---|---|
| 2012/0098711 | A1 | 4/2012 | Yosui |
| 2012/0098724 | A1 | 4/2012 | Yosui |
| 2012/0112978 | A1 | 5/2012 | Ito |

FOREIGN PATENT DOCUMENTS

| | | | |
|---|---|---|---|
| EP | 2 293 383 | | 3/2011 |
| EP | 2 296 228 | | 3/2011 |
| GB | 2469209 | A * | 10/2010 |
| JP | 2006-295981 | | 10/2006 |
| JP | 2007-006123 | | 1/2007 |
| JP | 2008-035459 | | 2/2008 |
| JP | 4325621 | | 6/2009 |
| JP | 2011-049936 | | 3/2011 |
| WO | 2007/020728 | | 2/2007 |
| WO | 2008/016138 | | 2/2008 |
| WO | 2011/036963 | | 3/2011 |

* cited by examiner

ANTENNA DEVICE AND COMMUNICATION APPARATUS INCLUDING THE SAME

BACKGROUND

1. Field of the Invention

The present invention relates to a communication apparatus which performs communication with a wireless communication medium such as RF-ID, that is, an IC card or an IC tag.

2. Description of the Related Art

In recent years, there has been proposed a mobile terminal such as a mobile phone which is provided with an RF-ID wireless tag or has a function of reading a non-contact IC card or IC tag. Further, as disclosed in Japanese Patent No. 4325621, a communication apparatus which employs an antenna device in which a coil axis of an antenna is perpendicular to a substrate has been widely used.

However, in the structure in which the coil axis is perpendicular to the substrate as in Japanese Patent No. 4325621, as will be described later, it is possible to read information when a non-contact IC card, for example, is disposed directly above the antenna device while being parallel to the substrate, but it is difficult to read information in other directions. That is, if the coil axis is perpendicular to a metal portion which is the substrate, magnetic lines flow one way approximately directly above a loop of the antenna. As a result, one-way magnetic lines are exerted to the non-contact IC card, and thus electric current is generated in the non-contact IC card. Thus, communication is performed between the mobile terminal and the non-contact IC card. However, in a direction other than the direction in which the non-contact IC card is disposed directly above the loop of the antenna, in particular, in a direction in which the non-contact IC card is disposed approximately directly across the loop of the antenna, magnetic lines which direct to the outside from the antenna side and magnetic lines which direct to the antenna side from the outside are generated. Thus, if the non-contact IC card is disposed approximately across the loop of the antenna while being approximately perpendicular to the metal portion, the magnetic lines in the opposite directions are generated to the non-contact IC card to then be canceled out. As a result, electric current cannot be generated in the non-contact IC card, and thus communication cannot be performed between the mobile terminal and the non-contact IC card.

SUMMARY

Accordingly, it is desirable to provide a communication apparatus which is capable of performing communication in a wide range, in a main communication surface through which communication is mainly performed.

According to an embodiment of the present invention, there is provided an antenna device including: a metal portion which has a surface; and an antenna which includes a coil section and is provided above the surface of the metal portion. Here, a surface of the coil section in which an opening portion is formed is approximately perpendicular to the surface of the metal portion, and the coil section is disposed in the vicinity of an edge of the metal portion.

According this embodiment, it is possible to provide an antenna device in which magnetic flux on the side of the metal portion among magnetic flux generated by the antenna device becomes weak, and the axis of the magnetic flux is inclined to the outside of the metal portion, thereby making it possible to perform good communication in a wide range.

Further, it is possible to provide a communication apparatus in which magnetic flux on the side of the metal portion among magnetic flux generated by the antenna device becomes weak, and the axis of the magnetic flux is inclined to the outside of the metal portion, thereby making it possible to perform good communication in a wide range.

Further, it is possible to provide a communication apparatus in which magnetic flux on the side of the metal portion among magnetic flux generated by the antenna device becomes weak, the axis of the magnetic flux is inclined to the outside of the metal portion, and particularly, a large magnetic field surrounds a main communication surface, thereby making it possible to perform good communication in a wide range.

DETAILED DESCRIPTION

First Embodiment

Hereinafter, a first embodiment of the invention will be described with reference to the accompanying drawings.

Figure 1:
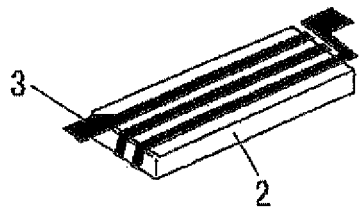
FIG. 1 is a conceptual diagram of an antenna according to first and second embodiments of the present invention.
Figure 2:
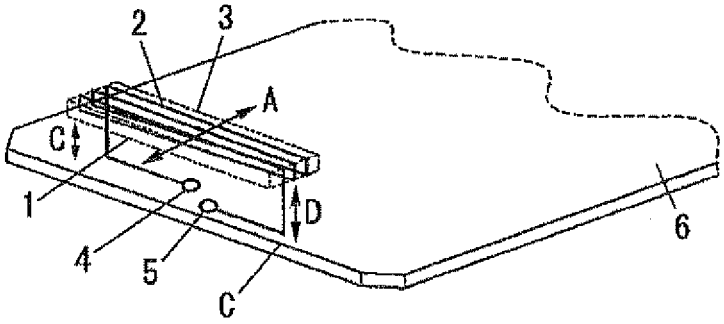
FIG. 2 is a conceptual diagram of an antenna device according to first and second embodiments of the invention.

FIG. 1 is a conceptual diagram of an antenna according to first and second embodiments of the invention. FIG. 2 is a conceptual diagram of an antenna device according to the first and second embodiments of the invention.

The antenna device provides a path in which electric current flows from an antenna input/output terminal 4 (or 5) to another antenna input/output terminal 5 (or 4). In the first embodiment, a surface surrounded by the path is defined as an opening surface of the antenna device. Further, an antenna 1 included in the antenna device is defined as a component which performs signal transmission and reception by electric current generated by a magnetic field generated by electric current or a magnetic field from an external field. Further, a surface (cross-sectional surface of a core 3) of the antenna 1 surrounded by the path is defined as an opening surface of the antenna 1.

That is, in the first embodiment, the antenna device is adjusted to be able to transmit and receive for example RFID radio waves (communication frequency of 13.56 MHz or the like).

In the first embodiment, the antenna 1 which includes a coil section 2 and the core 3 around which the coil section 2 is wound is inserted in a location in the middle of the path which forms the antenna device.

Further, the coil section 2 is inserted in a position facing the antenna input/output terminals 4 and 5. Thus, by connecting the coil section 2 to the antenna input/output terminals 4 and 5, it is possible to freely form the antenna device. Here, the position in which the coil section 2 is inserted is not limited to the facing position.

Further, when a coil axis of the coil section 2 is represented as A, the coil section 2 is arranged so that the coil axis A is perpendicular to the opening surface of the antenna device and is perpendicular to a direction (direction C) of electric current flowing in front and rear of a portion to which the coil section 2 on the path of the antenna 1 is inserted.

In the first embodiment, the coil axis A is perpendicular to the direction C, but may be differently directed as long as the coil axis A is not parallel to the direction C.

Further, in the first embodiment, the coil section 2 is arranged to be perpendicular to an edge surface B of a metal portion 6 which is spaced from the coil section 2 by a distance D. The distance D may be considered from 0 mm to ∞, but as described later, has reliable communication performance as the antenna device in any case. In FIG. 2, the distance D is 4 mm.

Further, it is desirable to use a magnetic body as the core 3 to increase magnetic flux which passes through the coil section 2 and to improve communication performance when the metal portion 6 moves close thereto. However, the core 3 is not limited to the metal portion, and may be formed of ceramics, resin or the like. In the first embodiment, a ferrite core is used, and its size is 8 mm×20 mm×0.2 mm.

Further, in the first embodiment, the number of turns of a conductor of the coil section 2 is about 6.5. The number of conductor portions wound on the surface of the core 3 facing the metal portion (in the surface of the core 3 facing the metal portion, the number of the conductor portions wound on the surface when the conductor is wound on the core 3) is smaller than the number of conductor portions wound on a surface opposite to the surface of the core 3 facing the metal portion.

With such a configuration, it is possible to obtain the antenna device having high efficiency with a small number of turns.

In FIG. 2, a long side of the cuboid core 3 is arranged on a loop of the antenna device, but a short side of the core 3 may be arranged thereon. Further, the shapes of the coil section 2 and the core 3 may be arbitrarily selected according to a desired characteristic or a mounting space.

Here, when the short side of the core 3 is arranged on the loop of the antenna device, the coil section 2 may be wound in the short side direction of the core 3.

Further, as the number of turns thereof increases, the intensity of magnetic field increases. In this regard, when the number of turns increases to an integer plus 0.5, the increase rate of the magnetic field intensity significantly increases.

Here, the number of turns is not limitative, and may be larger or smaller than about 2.5 shown in FIG. 2.

When the number of turns increases or decreases to about 0.5 from the integer, since both edges of the coil section 2 (sections connected with the antenna device) can become both sides with the core 3 being interposed therebetween, it is easy to insert the coil section 2 in the antenna device.

That is, since it is possible to insert the coil section 2 in such a manner that a rectilinear portion of a normal loop antenna is replaced, it is easy to insert the coil section 2.

Further, the coil section 2 may be wound clockwise or counterclockwise, which may be appropriately selected according to an arrangement position.

Further, the coil section 2 and the conductor of the antenna device may be connected with each other by a connection method which is usually used such as connection through soldering or a connector. Alternatively, the coil section 2 and the antenna device 1 may be formed by a single conductor. The antenna input/output terminals 4 and 5 are connected to a matching circuit and an IC input/output terminal as generally known, which may be performed by a connection method which is usually used such as contact through a pin or a spring, or connection through soldering or a connector.

Figure 3:
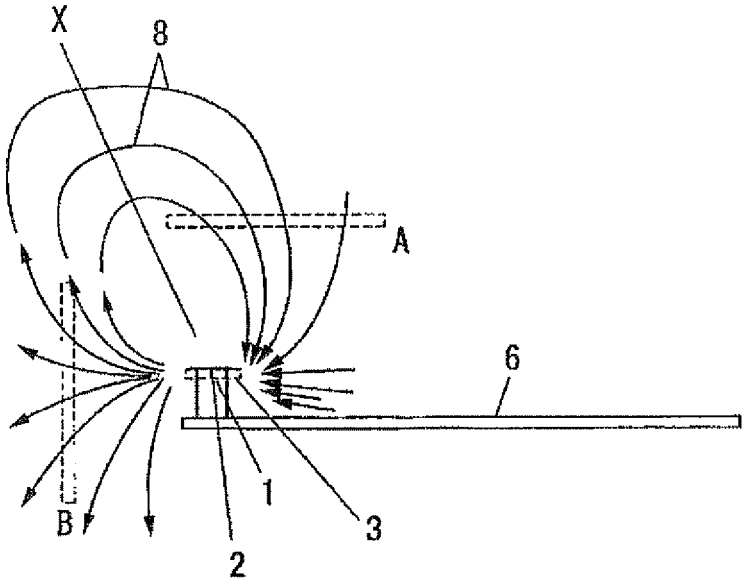
FIG. 3 is a conceptual diagram of magnetic lines generated from the antenna device shown in FIG. 2.
Figure 4:
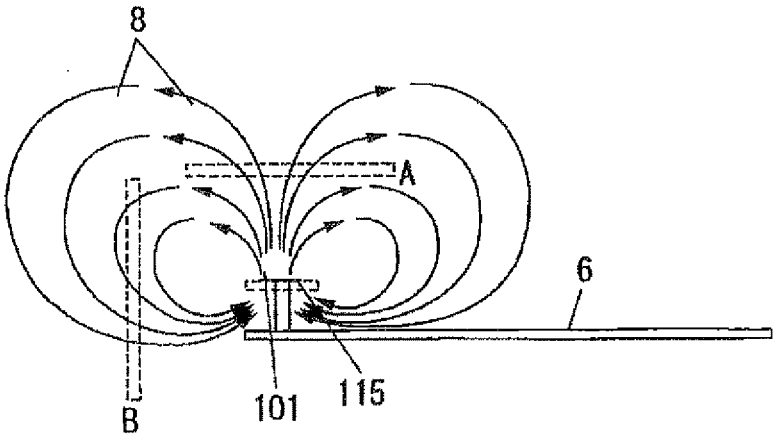
FIG. 4 is a conceptual diagram of an antenna device in the related art.
Figure 5:
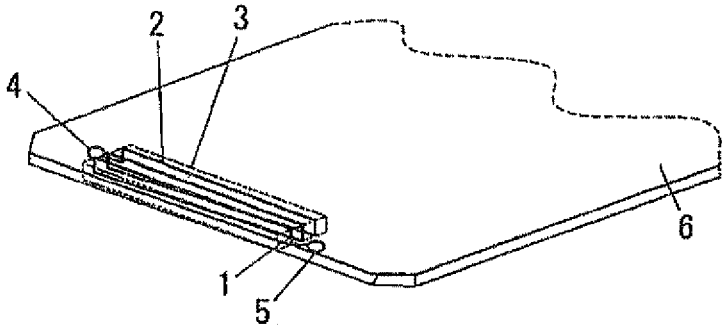
FIG. 5 is a conceptual diagram of an antenna device according to a first embodiment of the invention.
Figure 6:
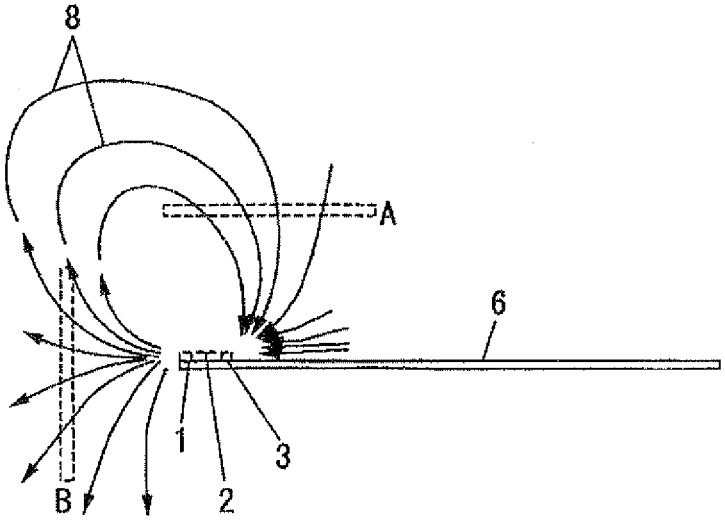
FIG. 6 is a conceptual diagram illustrating magnetic lines generated from the antenna device shown in FIG. 5.
Figure 7:
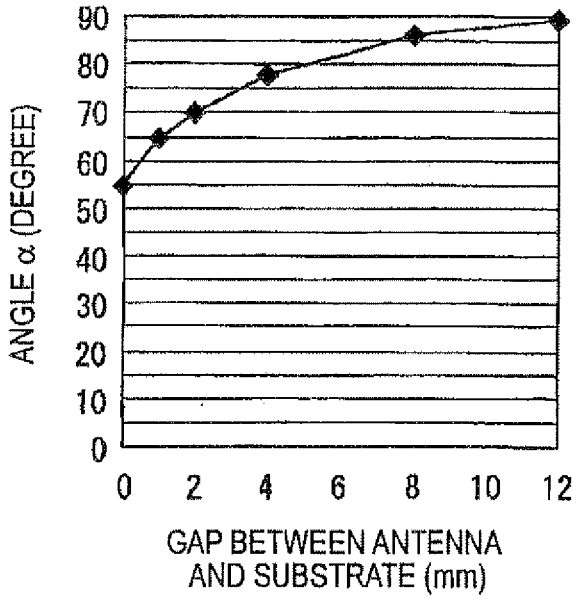
FIG. 7 is a diagram illustrating the relationship between a distance D and an angle $\alpha$ of an axis X of a magnetic field.
Figure 8:
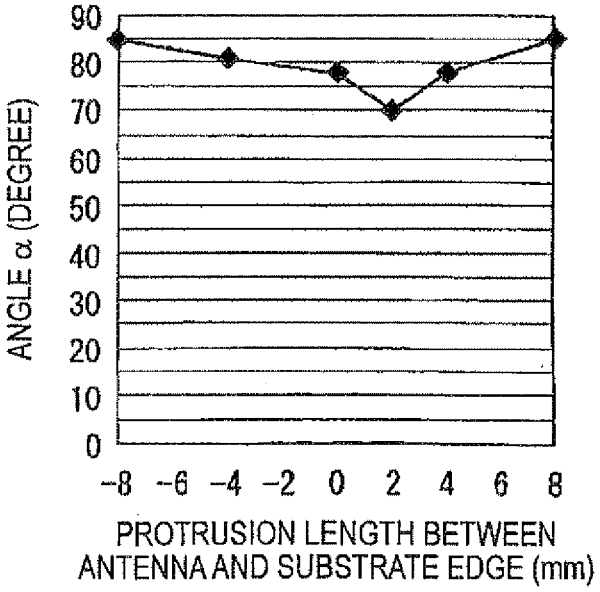
FIG. 8 is a diagram illustrating the relationship between a distance d and an angle $\alpha$ of an axis X of a magnetic field.

Next, a magnetic field generated by the antenna device will be described with reference to FIG. 3. FIG. 3 is a conceptual diagram illustrating magnetic lines generated from the antenna device shown in FIG. 2. Further, FIG. 4 illustrates a conceptual diagram of an antenna device in the related art, for the purpose of comparison. FIG. 5 is a conceptual diagram of an antenna device according to another first embodiment of the invention. FIG. 6 is a conceptual diagram illustrating magnetic lines generated from the antenna device shown in FIG. 5. FIG. 7 is a diagram illustrating the relationship between a distance D and an angle α of an axis X of a magnetic field, and FIG. 8 is a diagram illustrating the relationship between a distance d and the angle α of the axis X of the magnetic field.

As shown in FIG. 3, the antenna device according to the first embodiment includes the antenna 1 having the coil section 2 and the metal portion 6 arranged adjacent to the antenna 1. The opening portion of the coil section 2 of the antenna 1 is perpendicular to the metal portion 6, and the antenna 1 is arranged in an edge of the metal portion 6. The edge of the metal portion 6 includes a case where an edge of the antenna 1 protrudes outside the outermost edge of the metal portion 6 and a case where the edge of the antenna 1 is disposed inside the outermost edge of the metal portion 6. It is preferable that the distance d between the edge of the antenna 1 and the edge of the metal portion 6 is about −8 mm to +8 mm (which will be described later).

In contrast, as shown in FIG. 4, in an antenna device of the related art, an opening portion of an antenna 101 is parallel to the metal portion 6. Electric current flows in the antenna 101 by a signal input to an antenna input/output terminal. Magnetic lines generated from the antenna 101 are one-way in a direction distant from the antenna in a region A. As a result, one-way magnetic lines are exerted on a non-contact IC card, for example, positioned in the region A, and electric current is generated in the non-contact IC card, to thereby allow the mobile terminal and the non-contact IC card to communicate with each other. However, since the magnetic lines extend in two opposite directions of a direction distant from the antenna and a direction approaching the antenna in a region B, they are thereby cancelled out. Accordingly, if the non-contact IC card is disposed in the region B, that is, if the non-contact IC card is disposed approximately perpendicular to the metal portion approximately directly beside the antenna, magnetic lines in opposite directions are exerted and canceled out in relation to the non-contact IC card. As a result, it is difficult to generate the electric current to the non-contact IC card, and also to perform communication between the mobile terminal and the non-contact IC card.

However, since this embodiment includes the antenna 1 having the coil section 2 and the metal portion 6 arranged adjacent to the antenna 1, the opening portion of the coil section 2 of the antenna 1 is perpendicular to the metal portion 6, and the long side of the coil section 2 of the antenna 1 is parallel to the outermost edge of the metal portion 6 and is disposed in the edge thereof, for example, even though the non-contact IC card is disposed in the region B as well as in the region A, good communication can be performed.

That is, electric current flows in the antenna 1 by a signal input to the antenna input/output terminal 4 or 5. Since the opening portion of the antenna 1 is perpendicular to the metal portion 6, the magnetic lines generated from the antenna 1 are one-way to a direction distant from the antenna 1 in the region B. As a result, one-way magnetic lines are exerted to the non-contact IC card, for example, disposed in the region B, and electric current is generated in the non-contact IC card, thereby making it possible to perform communication between the mobile terminal or the like which is mounted with the antenna device according to the first embodiment and the non-contact IC card.

Further, in the region A, the magnetic lines are also one-way in either the direction distant from the antenna 1 or the direction approaching the antenna 1. This is because the magnetic field 8 generated from the antenna 1 attenuates in the vicinity of the metal portion 6 and the axis X of the magnetic field 8 is inclined to the metal portion 6 without being perpendicular thereto. The X axis of the magnetic field 8 is a straight line of connecting boundaries of the magnetic lines in the direction distant from the antenna 1 and the magnetic lines in the direction approaching the antenna 1. Accordingly, if the non-contact IC card, for example, is disposed in the vicinity of the axis X of the magnetic field 8, both the magnetic lines in the direction distant from the antenna and the direction approaching the antenna are exerted to the non-contact IC card, for example, as in the region B in FIG. 4. As a result, since both the magnetic lines are cancelled out each other, it is difficult to communicate with the mobile terminal or the like which is mounted with the antenna device according to the first embodiment.

Next, the reason why the axis X of the magnetic field 8 is inclined to the metal portion 6 will be described. That is, eddy current induced to the surface of the metal portion 6 produces a magnetic field in a direction perpendicular to the surface of the metal portion 6. Thus, the magnetic field generated from the antenna 1 and the magnetic field generated from the eddy current induced to the surface of the metal portion 6, are combined. As a result, the magnetic field 8 generated by the antenna 1 is changed in a perpendicular direction in the vicinity of the metal portion 6, and the axis X of the magnetic field 8 is inclined on a side distant from the metal portion 6.

Further, since the antenna 1 is disposed on the edge of the metal portion 6, the magnetic field of the antenna 1 on the side of the metal portion 6 (right side in FIG. 3) can be attenuated, and the magnetic field of the antenna 1 on the side distant from the metal portion 6 can be relatively strengthened. As a result, the axis X of the magnetic field 8 can be inclined to the metal portion 6. In the configuration of the first embodiment, the angle $\alpha$ of the axis X of the magnetic field 8 is about 40 to 85 degrees with respect to the metal portion 6. That is, if the antenna 1 is not disposed in the edge of the metal portion 6, the magnetic field of a direction perpendicular to the surface of the metal portion 6, generated due to the eddy current on the surface of the metal portion 6 becomes small, and the axis X of the magnetic field 8 becomes approximately perpendicular to the metal portion 6. In this case, communication is impossible in the region A, while communication is possible in the region B.

Further, as shown in FIG. 7, it is preferable that the distance D between the antenna 1 and the metal portion 6 be 0 mm to 8 mm. In FIG. 7, the distance d between the edge of the antenna 1 and the edge of the metal portion 6 is 0 mm. Particularly, in the case of 0 mm to 4 mm, the angle $\alpha$ of the axis X of the magnetic field 8 can be significant, that is, 55 to 80 degrees. Further, in the case of 8 mm to 12 mm, the angle $\alpha$ can be also about 85 degrees. This is because, if the antenna 1 is excessively separated from the metal portion 6, the influence of the metal portion 6 decreases, and thus the force by which the metal portion 6 makes the axis X of the magnetic field 8 inclined decreases. Further, the communication distance is affected by the size of the metal portion 6. That is, as the metal portion 6 is large, and as the side on which the antenna is mounted is long, the communication distance becomes long.

Further, in FIGS. 3 to 6, the edge of the antenna 1 and the edge of the metal portion 6 are disposed to be aligned, and the distance d between the edge of the antenna 1 and the edge of the metal portion 6 is 0 mm. However, as shown in FIG. 8, the edge of the antenna 1 may protrude from the outermost edge of the metal portion 6. In FIG. 8, the distance D between the antenna 1 and the metal portion 6 is 4 mm, and the distance D is plus when the edge of the antenna 1 protrudes from the outermost edge of the metal portion 6. As the edge of the antenna 1 protrudes from the edge of the metal portion 6, the magnetic field 8 directly above (on the side of the region A) the metal portion is strengthened. However, if the edge of the antenna 1 excessively protrudes from the edge of the metal portion 6, the force by which the metal portion 6 makes the axis X of the magnetic field 8 inclined becomes weakened. Accordingly, the angle $\alpha$ is 70 degrees when d=2 mm, which is most inclined. Here, even when the protrusion is 8 mm, the angle $\alpha$ may be 85 degrees.

Further, the edge of the antenna 1 may be disposed inside the outermost edge of the metal portion 6. At this time, if the distance d is represented as negative in FIG. 8. If the position of the edge of the antenna 1 is disposed excessively inside the outermost edge of the metal portion 6, the magnetic field 8 (magnetic field 8 directing to the side of the region B) on the left side in FIG. 3 attenuates, and thus the whole magnetic field 8 becomes weakened. In this way, since the magnetic field attenuates, the axis X of the magnetic field 8 comes close perpendicular to the metal portion 6. Accordingly, the angle $\alpha$ is 78 degrees when d=0 mm, and the angle $\alpha$ is 85 degrees when d=−8 mm.

As described above, by disposing the antenna 1 on the edge of the metal portion 6, it is possible to effectively use the electric current flowing in the metal portion 6. Further, if the angle $\alpha$ is about 85 degrees, the effects of the invention are obtained. Preferably, the angle $\alpha$ may be 85 degrees or less.

Next, results obtained by comparing the communication distances in directions approaching the regions A and B, of the antenna device according to the first embodiment shown in FIG. 2 and the antenna device in the related art shown in FIG. 4, will be described with reference to Table 1 and Table 2.

In this test, in the antenna device according to the first embodiment shown in FIG. 2, the core 3 is a ferrite core, and its size of 8 mm×26 mm×0.4 mm. The coil section 2 has 6.5 turns, and the distance D between the metal portion 6 and the antenna 1 is 4 mm. Further, in the antenna device in the related art shown in FIG. 4, the core 3 is a ferrite core, and its size is 15 mm×25 mm×0.4 mm. The coil section 2 has 2 turns, and the distance D between the metal portion 6 and the antenna 1 is 4 mm.

Table 1 corresponds to a case where a communication partner of the antenna device shown in FIGS. 2 and 4 is a non-contact IC card, and Table 2 corresponds to a case where the communication partner is a reader/writer device.

TABLE 1

| | Region A Direction | Region B Direction |
|---|---|---|
| FIG. 2 | 31 mm | 31 mm |
| FIG. 4 | 35 mm | 18 mm |

TABLE 2

| | Region A Direction | Region B Direction |
|---|---|---|
| FIG. 2 | 48 mm | 44 mm |
| FIG. 4 | 40 mm | 23 mm |

As is clear from Table 1 and Table 2, the antenna device according to the first embodiment shown in FIG. 2 can perform good communication in the region B, compared with the antenna device in the related art shown in FIG. 4. Further, it is clear that the antenna device according to this embodiment can also perform good communication in the region A.

In FIG. 2, the antenna device and the metal portion 6 are disposed at a certain degree of gap, but in the case of being disposed in the mobile terminal or the like, the gap may not be secured. In this case, the antenna device and the metal portion 6 are disposed to be close to each other as shown in FIG. 5. FIG. 5 is a conceptual diagram of an antenna device according to another first embodiment of the invention. FIG. 6 is a conceptual diagram illustrating magnetic lines generated from the antenna device shown in FIG. 5. In FIGS. 5 and 6, the distance D between the metal portion 6 and the antenna 1 is 0 mm. In this case, in a similar way to that of FIGS. 2 and 3, eddy current induced to the surface of the metal portion 6 produces a magnetic field reverse to the transport waves of the antenna 1. Thus, the magnetic field generated from the antenna 1 and the magnetic field generated from the eddy current induced to the surface of the metal portion 6, are balanced. As a result, the magnetic field 8 generated from the antenna 1 attenuates in the vicinity of the metal portion 6 and the magnetic field 8 of the side (side close to the region B in FIG. 6) distant from the metal portion 6 is relatively strengthened, so that the axis X of the magnetic field 8 is inclined to the side distant from the metal portion 6.

Further, since the antenna 1 is disposed at the edge of the metal portion 6, the magnetic field of the antenna 1 on the side (right side in FIG. 6) of the metal portion 6 can be attenuated, and the magnetic field of the antenna 1 on the side (left side in FIG. 6) distant from the metal portion 6 can be relatively strengthened. As a result, since the axis X of the magnetic field 8 can be inclined to the metal portion 6, for example, even when the non-contact IC card is disposed in either the region A or the region B, it is possible to perform good communication.

For example, the metal portion 6 is provided as a substrate in the mobile terminal, but may be provided as a different metal portion such as a battery or a liquid crystal display panel.

Further, the conductor which forms the antenna device may be formed of a coated copper wire or the like, or may be formed of an electrode pattern or the like formed on the metal portion 6. The coil section 2 and the magnetic core 3 may also be mounted on the metal portion 6. Although not shown in the figures, different components such as a camera module, a speaker, an RF module, and a different frequency antenna may be mounted on an empty space inside the loop of the antenna device.

Further, by aligning the edge surface of the antenna 1 which is parallel to the opening portion of the coil section 2 and the edge of the metal portion 6, it is possible to provide an antenna device which can be easily manufactured.

Further, by allowing the edge surface of the antenna 1 which is parallel to the opening portion of the coil section 2 to protrude from the edge of the metal portion 6, the magnetic field 8 in a region (the side of the region B) directly across the metal portion becomes strong.

Further, by bringing the antenna 1 into contact with the metal portion 6, the angle $\alpha$ of the axis X of the magnetic field 8 can be further reduced.

Further, since the coil section 2 is positioned at the edge of the metal portion 6, the electric current flowing in the metal portion 6 can be effectively used. Further, as the coil winding direction of the coil section 2 is parallel to the edge of the metal portion 6, it is possible to pick up a large amount of electric current flowing in the edge of the metal portion 6 with high efficiency, and to obtain desired characteristics of the antenna device.

Figure 9:
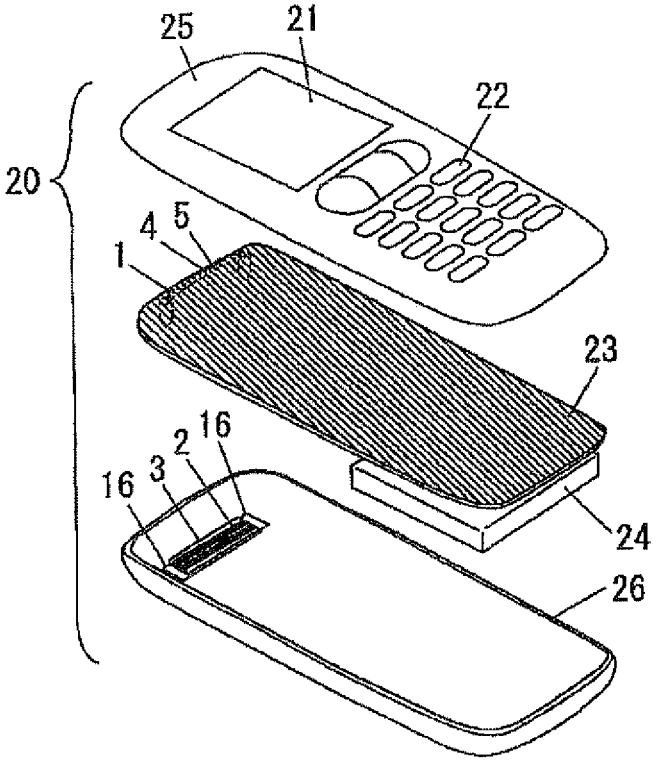
FIG. 9 is a perspective view in a case where a mobile terminal is disassembled.

Next, a case where the antenna device according to the present embodiment is mounted to a mobile terminal which is a communication apparatus will be described in detail. FIG. 9 is a perspective view in a case where a mobile terminal in a first embodiment is disassembled.

A mobile terminal 20 includes a liquid crystal display panel 21, an operation button 22, a casing 25, a casing 26, a substrate 23 contained therein, a battery 24, and the like.

The above-described metal portion 6 corresponds to the substrate 23 in FIG. 9, but may be formed as a metal portion on an inner surface of the casing 26 (a metallic film may be formed between the casing 26 and the coil section 2). In this way, by using the substrate 23 as the metal portion 6, it is possible to achieve miniaturization of the communication apparatus.

The antenna device, the coil section 2, the core 3 and the antenna input/output terminals 4 and 5 in this embodiment are formed inside the casing 26. The path of the antenna device and the antenna input/output terminals 4 and 5 are formed by sheet metal, a thin metallic tape, printing or the like, the coil section 2 is installed in a predetermined place of the casing 26 by adhesion of an adhesive tape, fixing through a screw, or the like. Connection between the path of the antenna device and the coil section 2 may be performed by contact connection such as a connector or pressure bonding, soldering or welding, or the like, and connection between the antenna input/output terminals 4 and 5 and the IC may be performed by pin connection, connector connection, conductor soldering, or the like.

In FIG. 9, the antenna device includes the path of the antenna device and the antenna input/output terminals 4 and 5 in the substrate 23, and is connected with the coil section 2 installed in the casing 26 through pins.

Components such as an RF-ID IC, a matching circuit, a different frequency antenna, a camera unit, a speaker, and an RF module are arranged in a space generated between the casing 26 and the substrate 23. Whether these components are in contact with or separated from the antenna device, the coil section 2 and the core 3, it is possible to perform good communication.

Further, since when the antenna device is formed as described above, the degree of freedom is high, the path of the antenna device formed on the substrate 23 may be arranged without interference with chips or the like arranged on the substrate 23.

The path of the antenna device may be arranged in a flat portion of the casing 26 in the first embodiment, but may be arranged along a curved surface of the casing 26.

According to the antenna device of the embodiment, since the communication characteristic of the antenna can be maintained, regardless of the distance between the antenna and the metal portion disposed in the casing which is mounted with the antenna, the antenna is effectively used as an antenna of a variety of electronic devices such as a mobile phone.

Second Embodiment

Hereinafter, a second embodiment of the invention will be described with reference to the accompanying drawings. The same reference numerals are given to the same components as those of the first embodiment. The main difference between the first embodiment and the second embodiment is a position where the antenna is disposed.

In a similar way to the first embodiment, description will be made with reference to FIGS. 1 and 2.

An antenna device provides a path in which electric current flows from an antenna input/output terminal 4 (or 5) to another antenna input/output terminal 5 (or 4). Further, an antenna 1 included in the antenna device is defined as a component which performs signal transmission and reception by electric current generated by a magnetic field generated by electric current or a magnetic field from an external field. Further, a central axis of a coil section 2 is defined as a coil axis A.

Further, it is desirable to use a magnetic body as the core 3 to increase magnetic flux which passes through the coil section 2 and to improve communication performance when the metal portion 6 moves close thereto compared with a case where the core 3 is not formed of the magnetic body. However, the core 3 is not limited to the metal portion, and may be formed of ceramics, resin or the like. In this embodiment, the core 3 is a ferrite core, and its size is 8 mm×20 mm×0.2 mm.

Further, in FIG. 2, the number of turns of a conductor of the coil section 2 is about 2.5. However, the number of turns is not limited thereto, but may be more or less than about 2.5 in FIG. 2.

Further, the coil section 2 and the conductor of the antenna device may be connected with each other by a connection method which is usually used such as contact through a pin or a spring, or connection through soldering or a connector. Alternatively, the coil section 2 and the antenna device may be formed of a single conductor. The antenna input/output terminals 4 and 5 are connected to a matching circuit and IC input/output terminals, as generally known.

Figure 10:
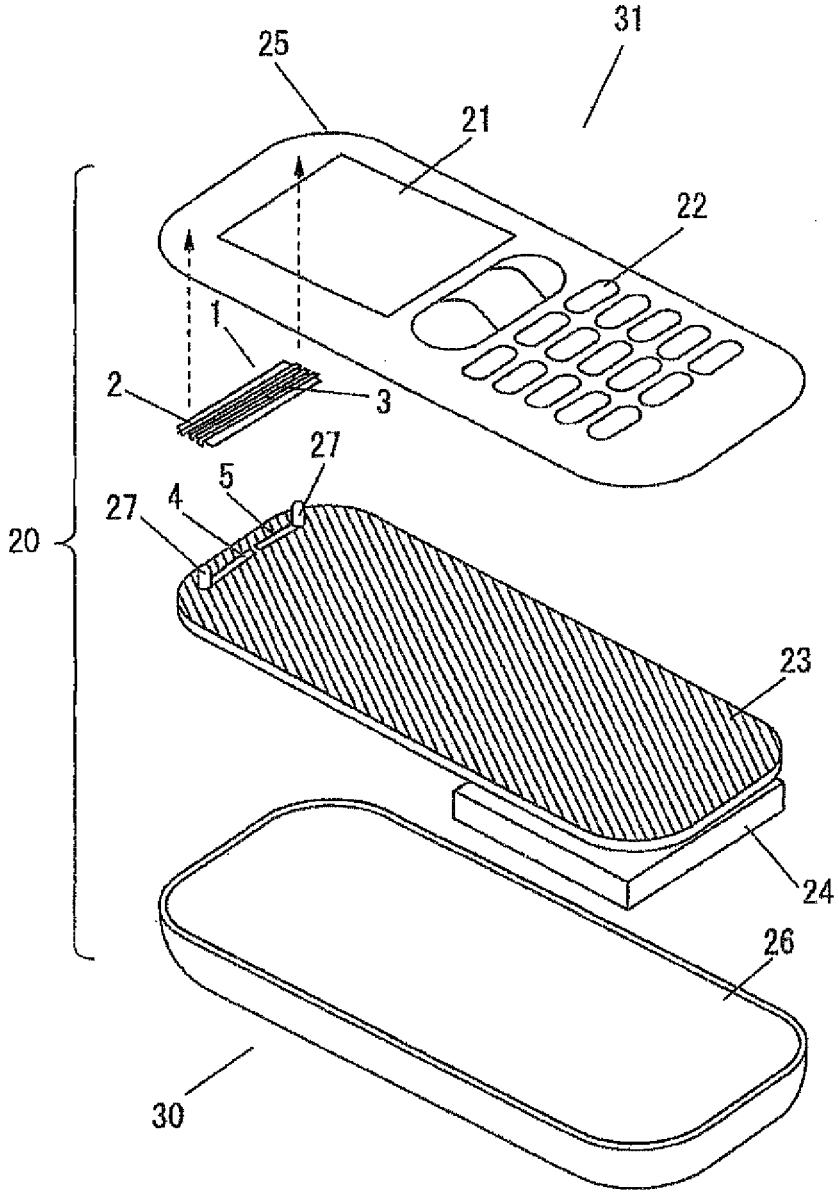
FIG. 10 is a perspective view in a case where a mobile terminal which is mounted with an antenna device is disassembled according to a second embodiment of the invention.

Next, a case where the antenna device of the invention is mounted on a mobile terminal which is a communication apparatus will be described in detail. FIG. 10 is a perspective view in a case where a mobile terminal which is mounted with the antenna device according to the second embodiment is disassembled.

The mobile terminal 20 includes a liquid crystal display panel 21, an operation button 22, a casing 25, a casing 26, a substrate 23 contained therein, a battery 24, and the like.

The above-described metal portion 6 corresponds to the substrate 23 in FIG. 10, but may be formed as a metal portion on an inner surface of the casing 26 (a metallic film may be formed between the casing 26 and the coil section 2). In this way, by using the substrate 23 as the metal portion 6, it is possible to achieve miniaturization of the communication apparatus.

The path of the antenna device and the antenna input/output terminals 4 and 5 are formed by sheet metal, a thin metallic tape, printing or the like, and the antenna 1 is installed in a predetermined place of the casing 25 by adhesion of an adhesive tape, fixing through a screw, or the like. The path connected to the antenna input/output terminals 4 and 5 and the antenna 1 is contact-connected with each other through pins 27 in FIG. 10, but may be connected by a connector or the like, or may be connected by a wire attached by soldering, welding or the like.

In the mobile terminal 20 which is mounted with the liquid crystal display panel 21, it is usual to perform communication with a surface thereof (lower side surface in FIG. 10) on the side of the casing 26 which is opposite to a surface thereof on which the liquid crystal display panel 21 is mainly installed being directed toward a wireless communication medium. That is, the surface opposite to the surface (lower side surface in FIG. 10) on which the liquid crystal display panel 21 is installed is used as a main communication surface 30 of the mobile terminal 20 in the second embodiment. Further, the surface on the side of the casing 25 which is opposite to the main communication surface 30 is a rear communication surface 31. In this embodiment, it is possible to obtain a communication device which is capable of performing good communication in a wide range on the main communication surface 30.

The antenna 1 includes the path of the antenna device and the antenna input/output terminals 4 and 5 in the substrate 23, on the side of the substrate 23 facing the casing 25, and is connected with the coil section 2 installed in the casing 26 through pins, to thereby form the antenna device.

Components such as an RF-ID IC, a matching circuit, a different frequency antenna, a camera unit, a speaker, and an RF module are arranged in a space generated between the casing 26 and the substrate 23. Whether these components are in contact with or separated from the antenna device, the coil section 2 and the core 3, it is possible to perform good communication.

Further, since when the antenna device is formed as described above, the degree of freedom is high, the path of the antenna device formed on the substrate 23 may be arranged without interference with chips or the like arranged on the substrate 23.

The path of the antenna device may be arranged in a flat portion of the casing 26 in the second embodiment, but may be arranged along a curved surface of the casing 26.

Figure 11:
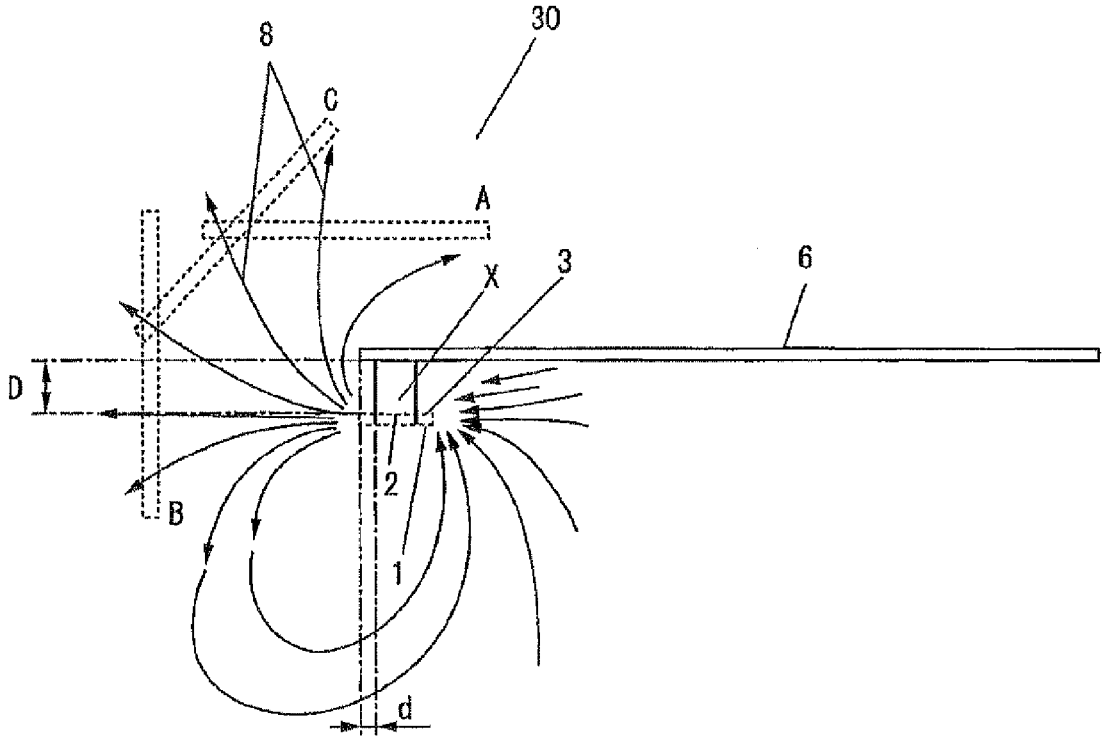
FIG. 11 is a conceptual diagram illustrating magnetic lines generated from the antenna device shown in FIG. 2.

Next, a magnetic field generated by the antenna device will be described with reference to FIG. 11. FIG. 11 is a conceptual diagram illustrating magnetic lines generated from the antenna device shown in FIG. 2. Further, referring to FIG. 4 with regard to the first embodiment, the antenna device in the related art will be described for comparison.

As shown in FIG. 11, the antenna device according to the second embodiment includes the antenna 1 having the coil section 2 and the metal portion 6 arranged adjacent to the antenna 1. The opening portion of the coil section 2 of the antenna 1 is perpendicular to the metal portion 6, and the antenna 1 is arranged in an edge of a surface of the metal portion 6 which is opposite to the main communication surface 30. The edge of the metal portion 6 includes a case where an edge of the antenna 1 protrudes outside the outermost edge of the metal portion 6 and a case where the edge of the antenna 1 is disposed inside the outermost edge of the metal portion 6. Preferably, the distance d between the edge of the antenna 1 and the edge of the metal portion 6 is about −8 mm to +8 mm (which will be described later).

On the other hand, as shown in FIG. 4, in the antenna device of the related art, the opening portion of the antenna 101 is parallel to the metallic plate 6. Electric current flows in the antenna 101 by a signal input to an antenna input/output terminal. Magnetic lines generated from the antenna 101 are one-way in the direction distant from the antenna in the region A. As a result, one-way magnetic lines are exerted on a non-contact IC card, for example, positioned in the region A, and electric current is generated in the non-contact IC card, to thereby allow the mobile terminal and the non-contact IC card to communicate with each other. However, since the magnetic lines simultaneously pass through the non-contact IC card in two opposite directions of the direction distant from the antenna and the direction approaching the antenna in the region B, voltage induced to the non-contact IC card is offset to be lowered. Accordingly, if the non-contact IC card is disposed in the region B, that is, if the non-contact IC card is disposed approximately perpendicular to the metal portion approximately directly across the antenna, it is difficult to perform communication between the mobile terminal and the non-contact IC card. That is, communication is possible only directly above the antenna device (in the region A) on the main communication surface of the communication apparatus.

However, since the embodiment includes the coil section 2, the metal portion 6 arranged adjacent to the coil section 2, and the casings 25 and 26 which contains the coil section 2 and the metal portion 6; the casings 25 and 26 include the main communication surface 30 which mainly performs communication; the opening portion of the coil section 2 is approximately perpendicular to the metal portion 6; the winding direction of the coil section 2 is approximately parallel to the outermost edge of the metal portion 6; and the coil section 2 is disposed in the edge of the surface which is not the side of the main communication section 30 of the metal portion 6, it is possible to perform good communication in a wide range in the main communication surface of the communication apparatus which mainly performs communication. The opening portion of the coil section 2 is approximately perpendicular to the metal portion 6, and the angle between the opening portion of the coil section 2 and the metal portion 6 is preferably 80 to 100 degrees. Further, the winding direction of the coil section 2 is approximately parallel to the outermost edge of the metal portion 6, but since the coil section 2 is wound in a spiral manner, it is difficult to make the whole coil section parallel to the edge of the metal portion 6. Accordingly, it is preferable that the winding direction of at least a part of the coil section be approximately parallel to the outermost edge of the metal portion 6. Further, the winding direction of the coil section 2 is approximately parallel to the outermost edge of the metal portion 6, which is preferably ±10 degrees.

That is, in FIG. 11, the electric current flows in the antenna 1 by the signal input to the antenna input/output terminal 4 or 5. Since the opening portion of the antenna 1 is perpendicular to the metal portion 6, the magnetic lines generated from the antenna 1 are one-way to a direction distant from the antenna 1 in the region B. As a result, one-way magnetic lines are exerted to the non-contact IC card, for example, disposed in the region B, and electric current is generated in the non-contact IC card, thereby making it possible to perform communication between the mobile terminal or the like which is mounted with the antenna device according to the second embodiment and the non-contact IC card.

Further, in the region A and a region C which are located on the side of the main communication surface 30, the direction of the magnetic lines is one-way. As shown in FIG. 11, since the antenna 1 is disposed in the edge of the metal portion 6, the magnetic lines extend in a radial manner from the edge of the metal portion 6. Particularly, since the axis X of the magnetic field 8 which is a straight line connecting boundaries of the magnetic lines of the direction distant from the antenna 1 and the magnetic lines of the direction approaching the antenna 1 is inclined to the metal portion 6, a larger amount of the magnetic field 8 surrounds the metal portion 6, thereby making it possible to enlarge a region of the main communication surface through which communication is possible.

Next, the reason why the axis X of the magnetic field 8 is inclined to the metal portion 6 will be described. The eddy current induced to the surface of the metal portion 6 by the magnetic field generated by the antenna 1 produces a magnetic field in a direction perpendicular to the surface of the metal portion 6. Thus, the magnetic field generated from the antenna 1 and the magnetic field from the eddy current induced to the surface of the metal portion 6 are combined, and as a result, the magnetic field 8 generated from the antenna 1 is changed in a perpendicular direction above the main surface of the metal portion 6, and the axis X of the metal portion 8 is inclined to the side distant from the metal portion 6.

In the configuration of the second embodiment, the inclined angle of the axis X of the magnetic field 8 is about 40 to 85 degrees with respect to the metal portion 6. That is, if the antenna 1 is not disposed at the edge of the metal portion 6, the magnetic field perpendicular to the surface of the metal portion 6, generated due to the eddy current on the surface of the metal portion 6 becomes small, and the axis X of the magnetic field 8 becomes approximately perpendicular to the metal portion 6.

Further, the distance D between the antenna 1 and the metal portion 6 is preferably 0 mm to 8 mm. Particularly, in the case of 0 mm to 4 mm, the angle of the axis X of the magnetic field 8 can be approximately 55 to 80 degrees. Further, in the case of 8 mm to 12 mm, the angle can be approximately 85 degrees. This is because if the antenna 1 and the metal portion 6 are excessively separated, the influence of the metal portion 6 decreases and the force by which the metal portion 6 makes the axis X of the magnetic field 8 inclined becomes weakened. Further, the communication distance is also affected by the size of the metal portion 6. That is, as the metal portion 6 becomes large and the side on which the antenna is mounted becomes long, the communication distance extends.

Further, in FIG. 11, the edge of the antenna 1 and the edge of the metal portion 6 are disposed to be aligned, and the distance d between the edge of the antenna 1 and the edge of the metal portion 6 is 0 mm. However, the edge of the antenna 1 may protrude from the outermost edge of the metal portion 6. The distance D between the antenna 1 and the metal portion 6 is 4 mm, and the distance d is plus when the edge of the antenna 1 protrudes from the outermost edge of the metal portion 6. As the edge of the antenna 1 protrudes from the edge of the metal portion 6, the magnetic field 8 directly above (on the side of the region A) the metal portion is strengthened. However, if the edge of the antenna 1 excessively protrudes from the edge of the metal portion 6, the force by which the metal portion 6 makes the axis X of the magnetic field 8 inclined becomes weakened. Accordingly, the angle $\alpha$ is 70 degrees when d=2 mm, which is most inclined. Here, even when the protrusion is 8 mm, the angle $\alpha$ can be 85 degrees.

Further, the edge of the antenna 1 may be disposed inside the outermost edge of the metal portion 6. At this time, if the distance d is represented as negative in FIG. 14. If the edge of the antenna 1 is disposed excessively inside the outermost edge of the metal portion 6, the perpendicular magnetic field induced to the surface of the metal portion 6 due to the eddy current is weakened, and is close to the magnetic field distribution of the antenna 1 in a case where the metal portion is not present. Accordingly, the angle is 78 degrees when d=0 mm, and the angle is 85 degrees when d=−8 mm.

As described above, by disposing the antenna 1 in the edge of the metal portion 6, it is possible to effectively use the electric current flowing in the metal portion 6. Further, if the angle is about 85 degrees, the effects of the invention are obtained. Preferably, the angle is 80 degrees or less.

Figure 14:
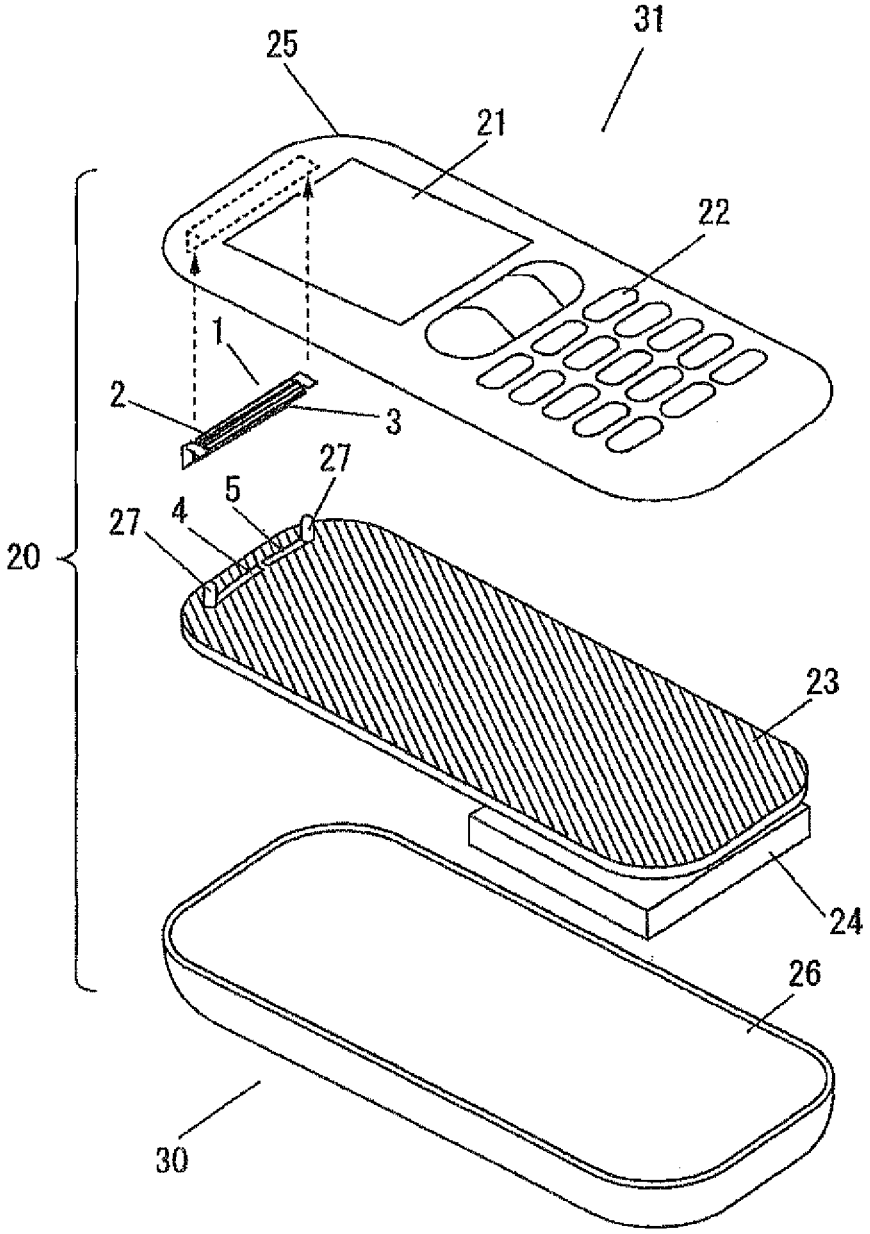
FIG. 14 is a perspective view in a case where a mobile terminal which is mounted with an antenna device is disassembled according to a second embodiment of the invention.
Figure 15:
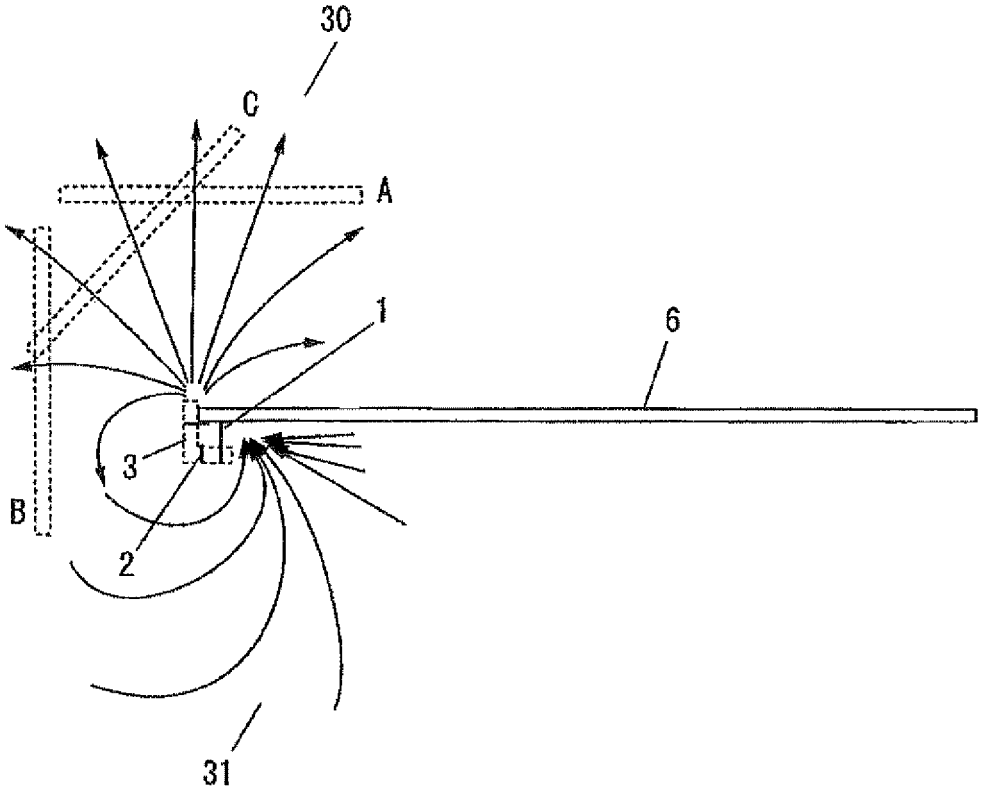
FIG. 15 is a conceptual diagram illustrating magnetic lines generated from the antenna device shown in FIG. 7.

Next, an embodiment in which the shape of the antenna in FIG. 1 is partially changed will be described. FIGS. 12A to 12D are conceptual diagrams of an antenna according to another second embodiment of the invention, in which FIG. 12A is a conceptual diagram when a cover is installed in the antenna, FIG. 12B is a conceptual diagram when the cover is removed from FIG. 12A, FIG. 12C is a conceptual diagram when a core is divided when the cover is removed from FIG. 12A, and FIG. 12D is a conceptual diagram when the core is removed from the state of FIG. 12B. FIG. 13 is a conceptual diagram of an antenna device according to a second embodiment of the invention. FIG. 14 is a perspective view in a case where a mobile terminal which is mounted with the antenna device is disassembled according to a second embodiment of the invention, and FIG. 15 is a conceptual diagram illustrating magnetic lines generated from the antenna device shown in FIG. 13.

The antenna shown in FIGS. 12*a* to 12D is partially different from the antenna shown in FIG. 1 in that a bent portion is formed and its size is changed, but its basic configuration is the same. In this second embodiment, the size of the ferrite core 3 is 8 mm×20 mm×0.2 mm, and the bent portion is formed with about 90 degrees at a position of 4 mm on the side of 8 mm, but the bent position is not limited to half, and may be longer or shorter. Preferably, the edge part of the bent core protrudes from the surface of the metal portion, and the magnetic field to the surface opposite to the antenna mounted surface can be strengthened. As a result, the coil section 2 includes a surface 40 which is approximately parallel to the metal portion 6, and a surface 41 facing the side of the outermost edge 42 of the metal portion. In this second embodiment, the coil section 2 is bent at 90 degrees, but is not limited thereto. That is, it is possible to bend the coil section 2 according to the shape of the casing which accommodates the antenna 1. Further, the core 3 may be formed with a curve so that the bent portion is not divided, as shown in FIG. 12B, or may be formed with a division line parallel to a long direction of the core 3, as shown in FIG. 12C. In this case, the coil 2 is wound in parallel with the long direction of the core 3 outside a fold line of the core 3 and is wound to be inclined with respect to the long direction of the core 3 inside the fold line of the core 3 so that the coil 2 is not overlapped with the fold line of the core 3, as shown in FIGS. 12C and 12D.

Figure 12:
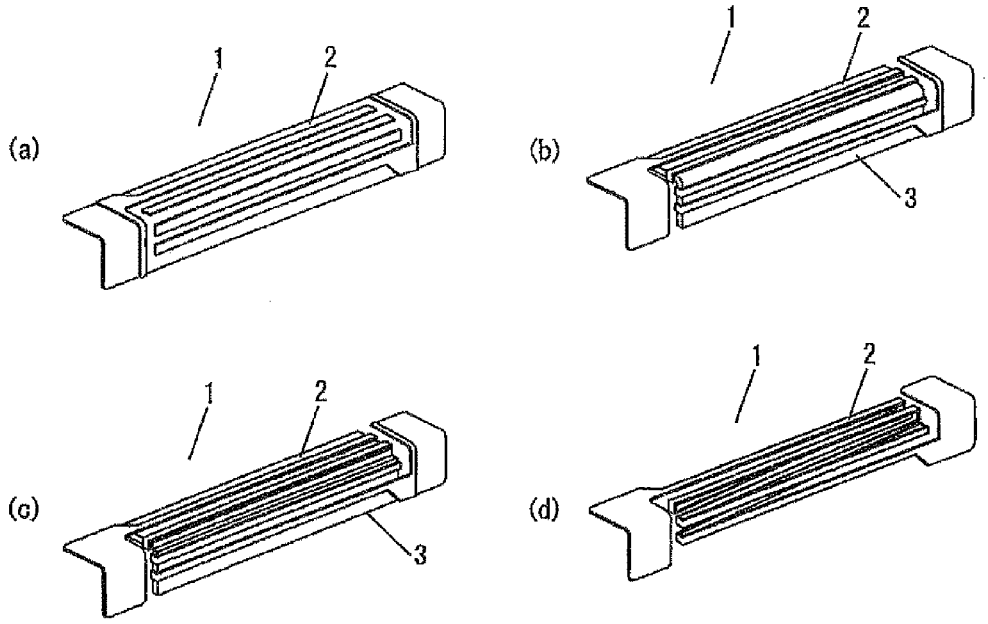
FIGS. 12A to 12D are conceptual diagrams of an antenna according to a second embodiment of the invention.
Figure 13:
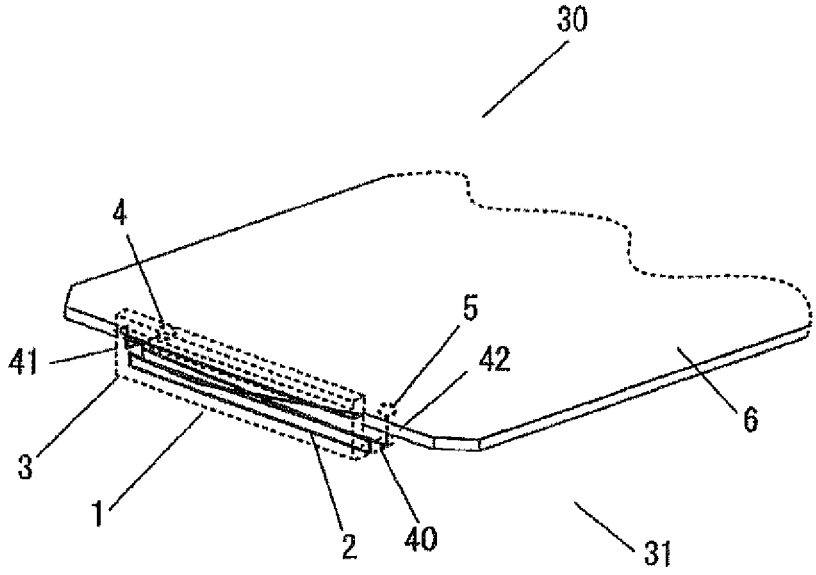
FIG. 13 is a conceptual diagram of an antenna device according to a second embodiment of the invention.

The antenna shown in FIG. 12 is installed to the metal portion 6 as shown in FIG. 13. In this second embodiment, the portion where the antenna 1 is bent protrudes from the surface of the metal portion 6 by about 1 mm. The gap between the metal portion 6 and the portion parallel to the metal portion 6 of the antenna 1 is about 2 mm. Further, the metal portion 6 corresponds to the substrate 23 in FIG. 14, but may be a metal portion which is formed on an inner surface of the casing 26 (the metal portion may be formed between the casing 26 and the coil section 2). In this way, by using the substrate 23 as the metal portion 6, it is possible to achieve miniaturization of the communication apparatus. Other configurations are the same as in FIG. 10.

Next, a magnetic field generated by the antenna device in FIG. 13 will be described with reference to FIG. 15.

As shown in FIG. 15, the antenna 1 is disposed in an edge of the surface opposite to the main communication surface 30 of the metal portion 6. The antenna 1 is bent at a position which is approximately half the length in the coil axis direction. Accordingly, the core 3 includes a surface parallel to the metal portion 6 and a surface approximately perpendicular thereto, and similarly, the coil axis of the coil section 2 includes a portion parallel to the metal portion 6 and a portion approximately perpendicular thereto. The approximately perpendicular surface of the antenna 1 protrudes from the surface of the metal portion 6. With such a configuration, the axis of the magnetic field 8 is significantly inclined with respect to the metal portion 6. Further, the magnetic field 8 extends in a radial manner from the edge of the metal portion 6 on the side of the main communication surface 30, and thus a region of the main communication surface 30 through which communication is possible can be significantly secured.

Next, the results obtained by comparing the communication distances in the directions approaching the regions A, B and C of the antenna device in this second embodiment shown in FIGS. 11 and 15 and the related art antenna device shown in FIG. 4 will be described with reference to Table 3 and Table 4. The region A is a region which is located directly above the antenna in the main communication surface, and the region B is a region which is located directly across the antenna and is located in a line extended from the metal portion. The region C is an intermediate region which is located between the region A and the region B and is inclined with respect to the metal portion 6.

In this test, in the antenna device of this second embodiment shown in FIGS. 11 and 15, the core 3 is a ferrite core, and the size of the antenna is 8 mm×26 mm×0.4 mm. The coil section 2 has 6.5 turns. In FIG. 11, the distance D between the metal portion 6 and the antenna 1 is 4 mm. In FIG. 15, the distance D between the metal portion 6 and the antenna 1 is 2 mm. Further, in the related art antenna device shown in FIG. 4, the core 3 is a ferrite core, and the size of the antenna is 15 mm×25 mm×0.4 mm. The coil section 2 has 2 turns, and the distance D between the metal portion 6 and the antenna 1 is 4 mm.

Table 3 corresponds to a case where a communication partner of the antenna device shown in FIGS. 11, 15 and 4 is a non-contact IC card, and Table 4 corresponds to a case where the communication partner is a reader/writer device.

TABLE 3

| | Region A Direction | Region B Direction | Region C Direction |
|---|---|---|---|
| FIG. 4 | 35 mm | 18 mm | 24 mm (With null) |
| FIG. 11 | 20 mm | 31 mm | 21 mm (Without null) |
| FIG. 15 | 38 mm | 27 mm | 34 mm (Without null) |

TABLE 4

| | Region A Direction | Region B Direction | Region C Direction |
|---|---|---|---|
| FIG. 4 | 40 mm | 23 mm | 30 mm (With null) |
| FIG. 11 | 30 mm | 44 mm | 31 mm (Without null) |
| FIG. 15 | 53 mm | 40 mm | 49 mm (Without null) |

As is clear from Table 3 and Table 4, by comparing the antenna device according to this second embodiment shown in FIGS. 11 and 15 with the related art antenna device shown in FIG. 4, it is possible to perform good communication with excellent balance in a wide range in the main communication surface 30. Further, in any one of the regions A, B and C, a null which is a region where the communication is not possible is not generated according to this second embodiment, whereas the null is generated in the related art.

In FIG. 2, the antenna device and the metal portion 6 are disposed at a predetermined gap, and the antenna 1 may be disposed adjacent to the metal portion 6, for example, may be placed thereon. In this case, the eddy current induced to the surface of the metal portion 6 becomes strong, and the perpendicular magnetic field to the main surface of the metal portion 6 due to the eddy current becomes strong. Then, the perpendicular magnetic field and the magnetic field of the antenna 1 are combined, and consequently, the axis X of the magnetic field 8 is inclined to the side distant from the metal portion 6.

As a result, for example, even though the non-contact IC card is disposed in any one of the regions A, B and C, it is possible to perform good communication.

For example, the metal portion 6 is provided as a substrate in the mobile terminal, but may be provided as a different metal portion such as a battery or a liquid crystal display panel.

Further, the conductor which forms the antenna device may be formed of a coated copper wire or the like, or may be formed of an electrode pattern or the like formed on the metal portion 6. The coil section 2 and the magnetic core 3 may be also mounted on the metal portion 6. Although not shown in the figures, different components such as a camera module, a speaker, an RF module, and a different frequency antenna may be mounted in an empty space between the antenna 1 and the substrate 23.

Further, by aligning the edge surface of the antenna 1 which is parallel to the opening portion of the coil section 2 and the edge of the metal portion 6, it is possible to provide an antenna device which can be easily manufactured.

Further, since the coil section 2 is positioned at the edge of the metal portion 6, the electric current flowing in the metal portion 6 can be effectively used. Further, as the coil winding direction of the coil section 2 is parallel to the edge of the metal portion 6, it is possible to pick up a large amount of electric current flowing in the edge of the metal portion 6 with high efficiency, and to obtain desired characteristics of the antenna device.

According to the antenna device, since the direction where communication is possible is not limited to one-way, it is possible to efficiently use the antenna device as an antenna of a variety of communication apparatus such as a mobile phone.

According to the first and second embodiments as described above, the following can be understood.

According to an embodiment of the invention, there is provided an antenna device including: a metal portion which has a surface; and a coil section which is provided above the surface and has an opening portion. Here, a surface of the coil section in which the opening portion is formed is approximately perpendicular to the surface of the metal portion, and the coil section is disposed in the vicinity of an edge of the metal portion. Thus, the magnetic flux generated by the antenna device is weakened on the side of the metal portion, and the axis of the magnetic flux is inclined outside the metal portion. Accordingly, it is possible to perform good communication in a wide range.

Further, the metal portion has an approximately rectilinear edge, and the surface in which the opening portion is formed is approximately parallel to the approximately rectilinear edge of the metal portion. Accordingly, it is possible to perform better communication in a wide range.

Further, the pair of opening portions of the coil section is disposed so that a first opening portion thereof is directed to a center side of the metal portion and a second opening portion thereof is directed to an external side of the metal portion. Accordingly, it is possible to perform good communication in a wide range more effectively using the metal portion. That is, it is possible to significantly incline the axis of the magnetic field.

Further, the first opening portion is disposed directly above the surface of the metal portion. Thus, the magnetic flux generated by the antenna device is sufficiently weakened on the side of the metal portion, and the axis of the magnetic flux is significantly inclined outside the metal portion. Accordingly, it is possible to perform good communication in a wide range.

Further, the first opening portion is disposed directly above the edge of the metal portion. Thus, the axis of the magnetic flux is inclined outside the metal portion while suppressing the magnetic flux generated by the antenna device from being weakened on the side of the metal portion. Accordingly, it is possible to perform good communication in a wide range.

Further, the second opening portion is disposed on an external side of the metal portion. Thus, the axis of the magnetic flux can be inclined outside the metal portion while suppressing the magnetic flux generated by the antenna device from being weakened on the side of the metal portion to the minimum. Accordingly, it is possible to perform good communication in a wide range.

Further, the second opening portion is disposed directly above the surface of the metal portion. Thus, the entire antenna device is disposed directly above the metal portion, the magnetic flux generated by the antenna device is sufficiently weakened on the side of the metal portion, and the axis of the magnetic flux is very significantly inclined outside the metal portion. Accordingly, it is possible to perform good communication in quite a wide range.

Further, the coil section is disposed above the surface of the metal portion while being separated from the surface of the metal portion. Thus, the axis of the magnetic flux is inclined outside the metal portion while suppressing the magnetic flux generated by the antenna device from being generally weakened on the side of the metal portion due to the influence of the metal portion to the minimum. Accordingly, it is possible to perform good communication in quite a wide range.

Further, the coil section is disposed above the surface of the metal portion while being in contact with the surface of the metal portion. Thus, the magnetic flux generated by the antenna device is effectively weakened on the side of the metal portion, and the axis of the magnetic flux is effectively inclined outside the metal portion. Accordingly, it is possible to perform good communication in quite a wide range.

According to another embodiment of the invention, there is provided an antenna device including: a metal portion which has a surface and an approximately rectilinear edge; and a coil section which is provided above the surface of the metal portion. Here, a surface of the coil section in which an opening portion is formed is approximately perpendicular to the surface of the metal portion, the surface in which the opening portion is formed is approximately parallel to the approximately rectilinear edge of the metal portion, and the coil section is disposed in the vicinity of an edge of the metal portion. Thus, the magnetic flux generated by the antenna device is weakened on the side of the metal portion, and the axis of the magnetic flux is inclined outside the metal portion. Accordingly, it is possible to perform good communication in quite a wide range in the most efficient state.

Further, the coil section is bent to be approximately parallel to a surface in which the first opening portion is formed and a surface in which the second opening portion is formed, between the surface in which the first opening portion is formed and the surface in which the second opening portion is formed, the surface in which the first opening portion is formed is approximately perpendicular to the surface of the metal portion, and the second opening portion is disposed outside the surface of the metal portion. Accordingly, it is also possible to perform good communication in a wide range, on the surface side opposite to the surface of the metal portion where the coil section is disposed.

Further, the surface in which the second opening portion is formed is approximately horizontal to the surface of the metal portion. Accordingly, it is also possible to efficiently perform good communication in a wide range, on the surface side opposite to the surface of the metal portion where the coil section is disposed.

Further, the second opening portion is disposed below the surface of the metal portion. Accordingly, it is also possible to efficiently perform good communication in quite a wide range, on the surface side opposite to the surface of the metal portion where the coil section is disposed.

According to still another embodiment of the invention, there is provided a communication apparatus including: a metal portion which has a surface; and a coil section which is provided above the surface and has an opening portion. Here, a surface of the coil section in which the opening portion is formed is approximately perpendicular to the surface of the metal portion, and an antenna is disposed in the vicinity of an edge of the metal portion. Further, there is provided a communication apparatus including: a metal portion which has a surface; a coil section which is provided above the surface of the metal portion; and a casing which accommodates the metal portion and an antenna and has a main communication surface through which communication is mainly performed. Here, a surface of the coil section in which the opening portion is formed is approximately perpendicular to the surface of the metal portion, the antenna is disposed in the vicinity of an edge of the metal portion, the pair of opening portions of the coil section is disposed so that a first opening portion thereof is directed to a center side of the metal portion and a second opening portion thereof is directed to an external side of the metal portion, and the coil section is disposed on the metal portion on the main communication surface. Thus, the magnetic flux generated by the antenna device is weakened on the side of the metal portion, and the axis of the magnetic flux is inclined outside the metal portion. Accordingly, it is possible to perform good communication in a wide range in the most efficient state.

According to still another embodiment of the invention, there is provided a communication apparatus including: a metal portion which has a surface; an antenna which includes a coil section and is provided above the surface of the metal portion; and a casing which accommodates the metal portion and the antenna and has a main communication surface through which communication is mainly performed. Here, a surface of the coil section in which an opening portion is formed is approximately perpendicular to the surface of the metal portion, the antenna is disposed in the vicinity of an edge of the metal portion, the pair of opening portions of the coil section is disposed so that a first opening portion thereof is directed to a center side of the metal portion and a second opening portion thereof is directed to an external side of the metal portion, and the coil section is disposed on the metal portion on a side opposite to the main communication surface. Thus, the magnetic flux generated by the antenna device is weakened on the side of the metal portion, and the axis of the magnetic flux is inclined outside the metal portion. Accordingly, it is possible to perform good communication in quite a wide range in the most efficient state, particularly in the main communication surface.

This application claims the benefit of Japanese Patent application No. 2010-168893 filed on Jul. 28, 2010, No. 2010-282784 filed on Dec. 20, 2010, the entire contents of which are incorporated herein by reference.

DESCRIPTION OF REFERENCE NUMERALS AND SIGNS

1 antenna
2 coil section
3 core
4, 5 antenna input/output terminals
6 metal portion
8 magnetic field
20 mobile terminal
21 liquid crystal display panel
22 button
23 substrate
24 battery
25, 26 casing

What is claimed is:

1. An antenna device comprising:

a metal portion which has a surface; and an antenna which includes a core and a coil section wound around the core and including one coil having one end connected to an input terminal and another end connected to an output terminal without another coil between the one coil and the input terminal and the one coil and the output terminal, the coil section provided above the surface of the metal portion and having an opening portion, the core including a first edge and a second edge which is opposite the first edge, wherein a surface of the coil section in which the opening portion is formed is approximately perpendicular to the surface of the metal portion, the antenna is disposed in the vicinity of a first edge of the metal portion, the first edge of the core is disposed in the vicinity of the first edge of the metal portion and the second edge of the core faces a second edge of the metal portion, a first distance between the first edge of the core and the first edge of the metal portion being shorter than a second distance between the second edge of the core and the second edge of the metal portion, and the antenna is spaced from the metal portion by a distance which is greater than the thickness of the core in a direction perpendicular to the surface of the metal portion.

2. The antenna device according to claim 1, wherein the metal portion has an approximately rectilinear edge, and wherein the surface in which the opening portion is formed is approximately parallel to the approximately rectilinear edge of the metal portion.

3. The antenna device according to claim 1, wherein the coil section includes a first opening portion and a second opening portion, the first opening portion being directed to a center side of the metal portion and the second opening portion being directed to an external side of the metal portion.

4. The antenna device according to claim 3, wherein the first opening portion is disposed directly above the surface of the metal portion.

5. The antenna device according to claim 3, wherein the first edge of the core is disposed directly above the first edge of the metal portion.

6. The antenna device according to claim 4, wherein the second edge of the core is disposed a third distance from the first edge of the metal portion and the third distance is greater than the first distance.

7. The antenna device according to claim 4, wherein the second opening portion is disposed directly above the surface of the metal portion.

8. An antenna device comprising:

a metal portion which has a surface and an approximately rectilinear edge; and an antenna which includes a core and a coil section wound around the core and including one coil having one end connected to an input terminal and another end connected to an output terminal without another coil between the one coil and the input terminal and the one coil and the output terminal, the coil section provided above the surface of the metal portion and having an opening portion, the core including a first edge and a second edge which is opposite to the first edge, wherein a surface of the coil section in which the opening portion is formed is approximately perpendicular to the surface of the metal portion, the surface in which the opening portion is formed is approximately parallel to the approximately rectilinear edge of the metal portion, the antenna is disposed in the vicinity of a first edge of the metal portion, the first edge of the core is disposed in the vicinity of the first edge of the metal portion and the second edge of the core faces a second edge of the metal portion, a first distance between the first edge of the core and the first edge of the metal portion being shorter than a second distance between the second edge of the core and the second edge of the metal portion, and the antenna is spaced from the metal portion by a distance which is greater than the thickness of the core in a direction perpendicular to the surface of the metal portion.

9. The antenna device according to claim 3, wherein the coil section is bent to be approximately parallel to a surface in which the first opening portion is formed and a surface in which the second opening portion is formed, between the surface in which the first opening portion is formed and the surface in which the second opening portion is formed, wherein the surface in which the first opening portion is formed is approximately perpendicular to the surface of the metal portion, and wherein the second opening portion is disposed outside the surface of the metal portion.

10. The antenna device according to claim 9, wherein the surface in which the second opening portion is formed is approximately horizontal to the surface of the metal portion.

11. The antenna device according to claim 9, wherein the second opening portion is disposed below the surface of the metal portion.

12. A communication apparatus, comprising:

a metal portion which has a surface;

an antenna which includes a core and a coil section wound around the core and including one coil having one end connected to an input terminal and another end connected to an output terminal without another coil between the one coil and the input terminal and the one coil and the output terminal, the coil section provided above the surface of the metal portion and has a pair of opening portions, the core including a first edge and a second edge which is opposite to the first edge; and a casing which accommodates the metal portion and the antenna and has a main communication surface through which communication is mainly performed, wherein a surface of the coil section in which at least one of the pair of opening portions is formed is approximately perpendicular to the surface of the metal portion, wherein the antenna is disposed in the vicinity of a first edge of the metal portion, the first edge of the core is disposed in the vicinity of the first edge of the metal portion and the second edge of the core faces a second edge of the metal portion, a first distance between the first edge of the core and the first edge of the metal portion being shorter than a second distance between the second edge of the core and the second edge of the metal portion, wherein the pair of opening portions of the coil section is disposed so that a first opening portion thereof is directed to a center side of the metal portion and a second opening portion thereof is directed to an external side of the metal portion, and wherein the coil section is disposed on the casing, and the antenna is spaced from the metal portion by a distance which is greater than the thickness of the core in a direction perpendicular to the surface of the metal portion.

13. A communication apparatus comprising:

a metal portion which has a surface;

an antenna which includes a core and a coil section wound around the core and including one coil having one end connected to an input terminal and another end connected to an output terminal without another coil between the one coil and the input terminal and the one coil and the output terminal, the coil section provided above the surface of the metal portion and has a pair of opening portions, the core including a first edge and a second edge which is opposite to the first edge; and a casing which accommodates the metal portion and the coil section and has a main communication surface through which communication is mainly performed, wherein a surface of the coil section in which at least of one of the pair of opening portions is formed is approximately perpendicular to the surface of the metal portion, wherein the antenna is disposed in the vicinity of a first edge of the metal portion, the first edge of the core is disposed in the vicinity of the first edge of the metal portion and the second edge of the core faces a second edge of the metal portion, a first distance between the first edge of the core and the first edge of the metal portion being shorter than a second distance between the second edge of the core and the second edge of the metal portion, wherein the pair of opening portions of the coil section is disposed so that a first opening portion thereof is directed to a center side of the metal portion and a second opening portion thereof is directed to an external side of the metal portion, wherein the coil section is disposed above the metal portion on a side opposite to the main communication surface, and the antenna is spaced from the metal portion by a distance which is greater than the thickness of the core in a direction perpendicular to the surface of the metal portion.

14. The antenna device according to claim 1, wherein when an outermost edge of the metal portion and an outermost edge of the coil section are aligned and a lateral distance between the outermost edge of the metal portion and the outermost edge of the coil section is zero and the lateral distance between the outermost edge of the metal portion and the outermost edge of the coil section ranges from minus a lateral length of the coil section from zero to plus the lateral length of the coil section from zero.

15. The antenna device according to claim 8, wherein when an outermost edge of the metal portion and an outermost edge of the coil section are aligned a lateral distance between the outermost edge of the metal portion and the outermost edge of the coil section is zero and the lateral distance between the outermost edge of the metal portion and the outermost edge of the coil section ranges from minus a lateral length of the coil section from zero to plus the lateral length of the coil section from zero.

16. The communication apparatus according to claim 12, wherein when an outermost edge of the metal portion and an outermost edge of the coil section are aligned a lateral distance between the outermost edge of the metal portion and the outermost edge of the coil section is zero and the lateral distance between the outermost edge of the metal portion and the outermost edge of the coil section ranges from minus a lateral length of the coil section from zero to plus the lateral length of the coil section from zero.

17. The communication apparatus according to claim 13, wherein when an outermost edge of the metal portion and an outermost edge of the coil section are aligned a lateral distance between the outermost edge of the metal portion and the outermost edge of the coil section is zero and the lateral distance between the outermost edge of the metal portion and the outermost edge of the coil section ranges from minus a lateral length of the coil section from zero to plus the lateral length of the coil section from zero.

18. An antenna device comprising:

a metal portion which has a surface and an outermost edge; and an antenna which includes a core and a coil section wound around the core, provided above the surface of the metal portion, the coil section having an opening portion and having an outermost edge, when the outermost edge of the metal portion and the outermost edge of the coil section are aligned, a lateral distance between the outermost edge of the metal portion and the outmost edge of the coil section is zero and the core including a first edge and a second edge which is opposite to the first edge, wherein a surface of the coil section in which the opening portion is formed is approximately perpendicular to the surface of the metal portion, and wherein the antenna is disposed in the vicinity of an edge of the metal portion, the first edge of the core is disposed in the vicinity of a first edge of the metal portion and the second edge of the core faces a second edge of the metal portion, a first distance between the first edge of the core and the first edge of the metal portion is shorter than a second distance between the second edge of the core and the second edge of the metal portion, and the lateral distance between the outermost edge of the metal portion and the outmost edge of the coil section ranges from minus a lateral length of the coil section from zero to plus a lateral length of the coil section from zero and an axis of a magnetic field of the coil section is inclined, and the antenna is spaced from the metal portion by a distance which is greater than the thickness of the core in a direction perpendicular to the surface of the metal portion.

19. An antenna device comprising:

a metal portion which has a surface; and an antenna which includes a core and a coil section wound around the core and including one coil having one end connected to an input terminal and another end connected to an output terminal without another coil between the one coil and the input terminal and the one coil and the output terminal, the coil section provided above the surface of the metal portion and having an opening portion, the core including a first edge and a second edge which is opposite to the first edge, wherein when an outermost edge of the metal portion and an outermost edge of the coil section are aligned a lateral distance between the outermost edge of the metal portion and the outermost edge of the coil section is zero and the lateral distance between the outermost edge of the metal portion and the outermost edge of the coil section ranges from minus a lateral length of the coil section from zero to plus the lateral length of the coil section from zero and an axis of a magnetic field of the coil section is inclined, wherein a surface of the coil section in which the opening portion is formed is approximately perpendicular to the surface of the metal portion, and wherein the antenna is disposed in the vicinity of an edge of the metal portion, the first edge of the core is disposed in the vicinity of a first edge of the metal portion and the second edge of the core faces a second edge of the metal portion, a first distance between the first edge of the core and the first edge of the metal portion is shorter than a second distance between the second edge of the core and the second edge of the metal portion, and the antenna is separated from the metal portion by a distance which is longer than the thickness of the core in a direction perpendicular to the surface of the metal portion.

* * * * *